US007963895B2

(12) United States Patent
Nohejl

(10) Patent No.: US 7,963,895 B2
(45) Date of Patent: Jun. 21, 2011

(54) COMPOUND ABDOMINAL DEVICE

(75) Inventor: Russell Nohejl, East Stroudsburg, PA (US)

(73) Assignee: Russell Nohejl, East Stroudsburg, PA (US)

( * ) Notice: Subject to any disclaimer, the term of this patent is extended or adjusted under 35 U.S.C. 154(b) by 0 days.

(21) Appl. No.: 12/461,663

(22) Filed: Aug. 20, 2009

(65) Prior Publication Data

US 2009/0312161 A1 Dec. 17, 2009

(51) Int. Cl.
*A63B 26/00* (2006.01)
*A63B 71/00* (2006.01)
*A63B 21/08* (2006.01)

(52) U.S. Cl. ..... 482/140; 482/97

(58) Field of Classification Search ..... 482/51, 482/92–97, 98–102, 133–137, 140, 142; D21/675, 687; *A63B 21/08, 26/00, 71/00*
See application file for complete search history.

(56) References Cited

U.S. PATENT DOCUMENTS

| | | | | |
|---|---|---|---|---|
| 4,387,893 | A * | 6/1983 | Baldwin | 482/137 |
| 5,665,041 | A * | 9/1997 | Hsieh | 482/140 |
| 5,669,865 | A * | 9/1997 | Gordon | 482/142 |
| 5,711,749 | A * | 1/1998 | Miller | 482/135 |
| 6,544,154 | B2 * | 4/2003 | Forcillo | 482/142 |
| 6,752,748 | B1 * | 6/2004 | Scotti | 482/140 |
| 6,884,203 | B2 * | 4/2005 | Forcillo | 482/142 |
| 6,966,872 | B2 * | 11/2005 | Eschenbach | 482/142 |
| 7,384,383 | B2 * | 6/2008 | Forcillo et al. | 482/140 |
| 7,611,445 | B2 * | 11/2009 | Brown et al. | 482/51 |
| 7,651,446 | B1 * | 1/2010 | Eschenbach | 482/52 |
| 2006/0211549 | A1 | 9/2006 | Nohejl | |
| 2008/0085822 | A1 * | 4/2008 | Webb et al. | 482/140 |
| 2009/0118104 | A1 * | 5/2009 | Chou | 482/94 |

* cited by examiner

*Primary Examiner* — Loan Thanh
*Assistant Examiner* — Oren Ginsberg
(74) *Attorney, Agent, or Firm* — Davidson Berquist Jackson & Gowdey, LLP

(57) ABSTRACT

A compound abdominal and upper body exercising device having an outer frame, an inner mechanism that is pivotally connected within the outer frame and on which a user kneels to initiate the exercise, a linkage system between the outer frame and the inner mechanism that interconnects an actuating assembly and the inner mechanism, and a weight support system connected to the inner mechanism.

18 Claims, 8 Drawing Sheets

COMPOUND ABDOMINAL DEVICE

CROSS-REFERENCE TO CO-PENDING APPLICATIONS

The present invention is related to the following U.S. patent application which is commonly owned with the present application, the entire contents of each being hereby incorporated herein by reference thereto: U.S. patent application Ser. No. 11/084,562, entitled "Abdominal Exercise and Training Apparatus," filed on Mar. 18, 2005, and was published on Sep. 21, 2006 as US2006/0211549.

COPYRIGHT NOTICE

A portion of the disclosure of this patent document may contain material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to an exercise device and in particular to a device for working abdominal and related upper body muscles while in a kneeling position.

INTRODUCTION

Glossary: As used throughout this document:

The phrase "outer frame" shall mean any a structure that will support the remaining portions of the exercise device.

The term "inner mechanism" shall include a variety of structures of varying shapes that are movably attached to and operatively supported by the outer frame, and which is movable by action of the user.

The term "actuating assembly" includes a structure that is moved and controlled by the user to, at least in part, move the inner mechanism relative to the outer frame.

The terms "linkage and linkage assembly" shall include the structure, device, arrangement or member operatively located between the actuating assembly and the inner mechanism, which may or may not be adjustable, and which transfers the actuating force and motion derived from the movement of the actuating assembly to the inner mechanism to thereby effect, at least in part, movement of the inner mechanism.

DESCRIPTION OF PRESENTLY PREFERRED EXAMPLES OF THE INVENTION

Brief Description of Figures

The invention is better understood by reading the following detailed description with reference to the accompanying drawings in which.

DESCRIPTION OF A PREFERRED EXEMPLARY EMBODIMENT

A. Overview

Figure 1:
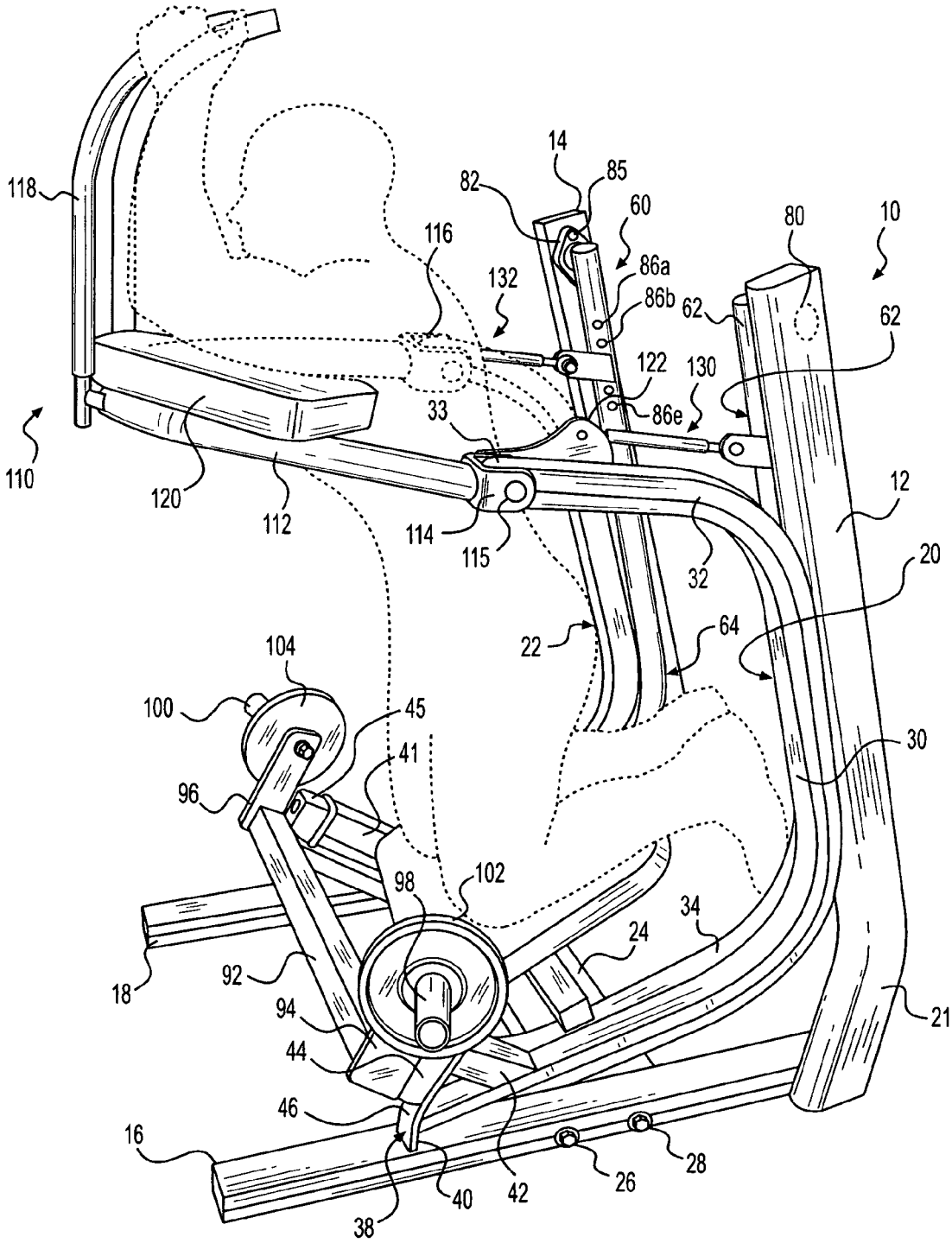
FIG. 1 is a side elevational view of the apparatus in its start position.

To gain a better understanding of the invention, a preferred exemplary embodiment will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The preferred embodiment now described will be with respect to a kneeling abdominal exercising device for use in gyms, homes, hotels, resorts, in sports clubs and anywhere else that exercising can occur. The scale of the embodiment, therefore, is to be understood with respect to this type of article. It is to be understood as well, however, that the invention is applicable to other articles and its scale can vary accordingly.

C. Structure

The device includes an outer support frame 10 in which an inner mechanism 60 is pivotally mounted. Outer frame 10 includes a pair of vertical rear supports 12 and 14, a bottom portion comprised of a pair of frontwardly extending floor supports 16 and 18 that are connected to and securely fastened to the rear supports 12 and 14, for example by being welded together.

An inner mechanism 60 is pivotally connected to and preferably within outer frame 10 and comprises a main portion of the whole device that will move relative to the outer frame and yield the exercise desired.

The outer frame 12 also includes a pair of additional supports 20 and 22, that will be discussed in further detail below, as well as a cross beam 24 that is connected by bolts 26 and 28 to floor supports 16 and 18 so as to extend there between and strengthen the stability of the outer frame 10.

As can be noted from FIG. 1 the bottom or foot portion of each of the rear supports 12 and 14 have a frontwardly curved lower section, one of which is shown at 21, that connects with a rear portion of each of the respective floor supports 16 and 18 with that connection technique including, for example, welding, bolts or some other equally strong approach that will produce a secure and preferably rigid connection.

The pair of additional supports 20 and 22 as shown are generally an elongated U-shaped members that are positioned in a side ways orientation. Since each is preferably the same only one, 20 as shown in the foreground of FIG. 1, will be described in detail. The additional support 20 includes three general sections with the first being a straight central portion 30, the second an upper section 32 and a third bottom section 34.

The central section 30 of each additional support is preferably welded to an interior portion of one of the vertical legs 12 or 14 or is otherwise connected thereto to provide additional stiffening to those rear supports. The upper section 32 extends outwardly from the rear support 12, at an upwardly directed angle from the central section 30, and has an outer end 33 that will provide a connection point for one side of an actuating assembly 110 as will be further discussed below. The other additional support 22 will have a similar section with an outer end that will also pivotally support an opposite side of the actuating assembly 110. Preferably, the outer end of the upper section 32 is spaced about 14 to about 18 and preferably about 15.5 inches away from rear support 12 and thereby defines the position of the actuating mechanism pivot point 115.

Figure 6:
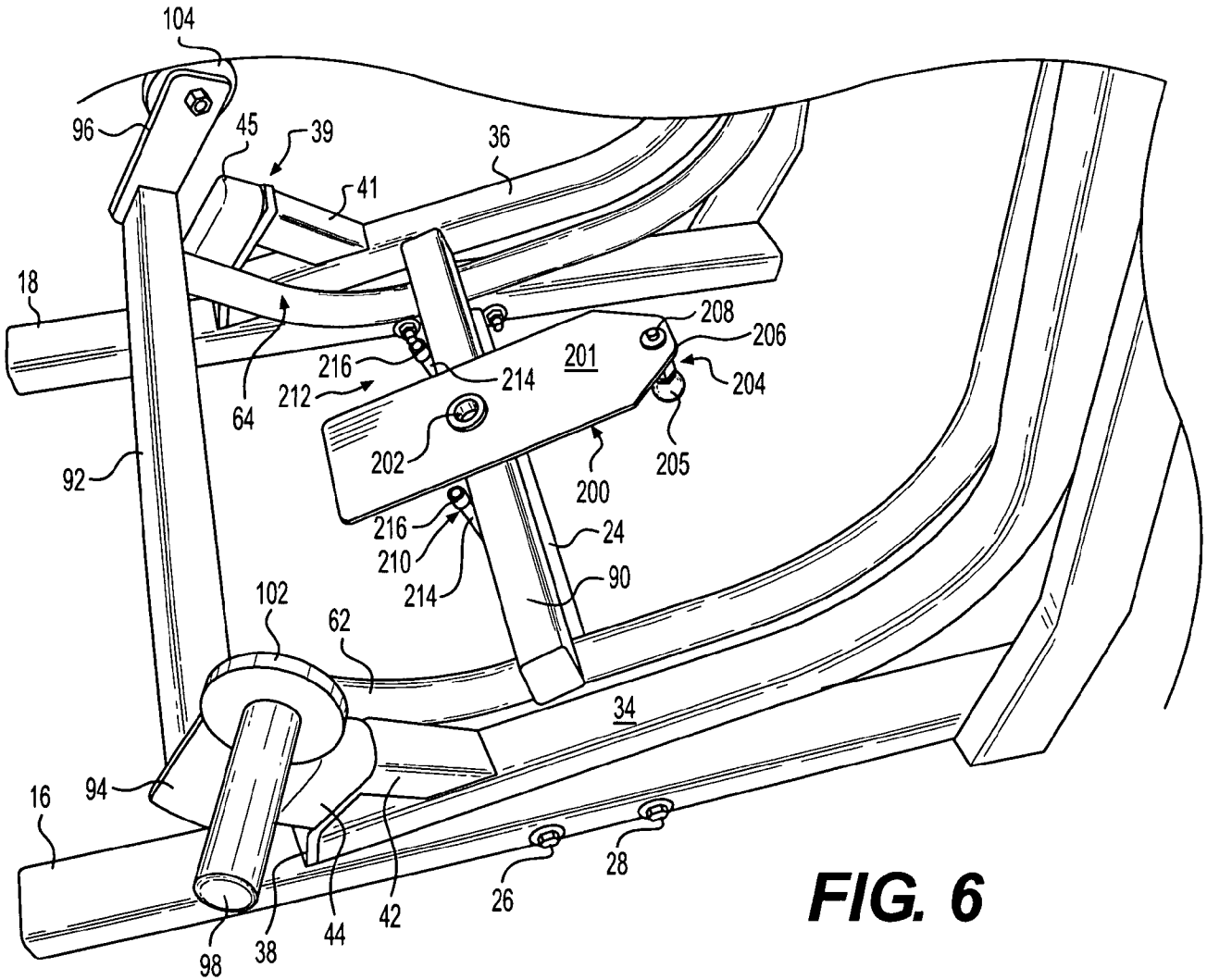
FIG. 6 is a view similar to FIG. 5 but with the knee pad support removed.

The bottom section 34 extends downwardly away from the bottom of the central section 30 and is angled toward the front of the bottom or floor support 16 to which it is connected, for example by welding. That connection can be direct or be connected to a rear surface of a short plate 38 whose bottom edge 40 is, in turn, welded to floor support 16. Plate 38 curves rearwardly to meet a support block 42 that is, in turn, welded between an adjacent surface of bottom section 34 and a rear surface of plate 38. A rubber bumper 44 is attached, for example by bolts or epoxy, to the upper front surface 46 of plate 38. Bumper 44 can be as wide as surface 46 and can be about 3-5 inches long. As shown in FIG. 6, a similar arrangement is used on the opposite side with a bumper 45 being mounted to plate 39 and a support block 41 is positioned between plate 39 and bottom section 36.

It should be understood that the U-shaped form of each of the additional supports 20 and 22 is only exemplary and that other shapes and forms of that structure could be used as well. For example, upper section 32 could be a separate member welded or otherwise attached at one end to rear supports 12/14. Alternatively, an additional upper section could be formed directly on an upper portion of the rear supports with such an additional or suitable structure providing an attachment point for a desired pivot connection for the inner mechanism 60 if additional height were needed to properly position that pivot point.

Middle section 30 would not be needed if the strength of rear supports 12 and 14 were sufficiently strong. Likewise, bottom sections 34 provide additional support between the rear supports and the bottom members 16 and 18 in order to resist the torque forces expected to be generated during use of the exercise device in order to move the inner mechanism 60 relative to the outer frame 10. Such support could be provided by a separate member interconnected between the bottom members 16/18 and the rear supports 12/14, by a plate positioned there between, or by a strong joint arrangement between the floor and rear supports.

Rear supports 12/14 can have a height ranging from about 2 feet to about 6 feet and preferably about 2.5 to about 4.5 feet, floor supports 16/18 can be about 2 feet to about 6 feet in length, but are preferably about 2.5-4.5 feet in length and the length of cross beam 24 can vary from about 20 to about 48 inches. The outer frame 10 and the additional supports 20 and 22 are each preferably made from steel extrusions that can have various cross-sectional shapes including circular, square, and rectangular or other bend resistant cross sections. It should be understood that outer frame 10 and the additional supports 20 and 22 could also be constructed from man made materials, including thermoplastics, carbon fibers, from combinations of materials, including metal and plastic, as well as from other reinforced materials.

Figure 2:
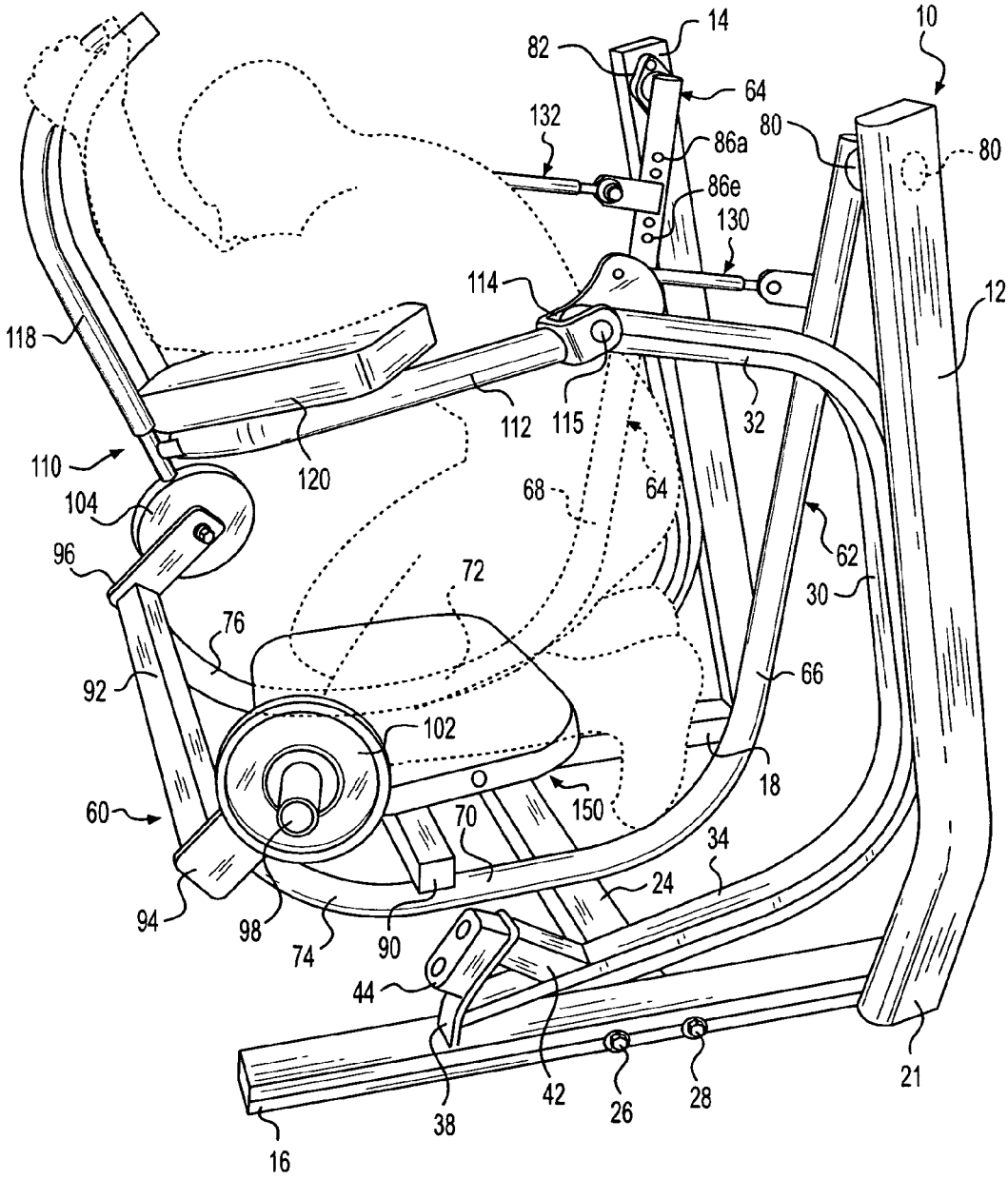
FIG. 2 is a view similar to FIG. 1 and showing a moved position of the apparatus.
Figure 3:
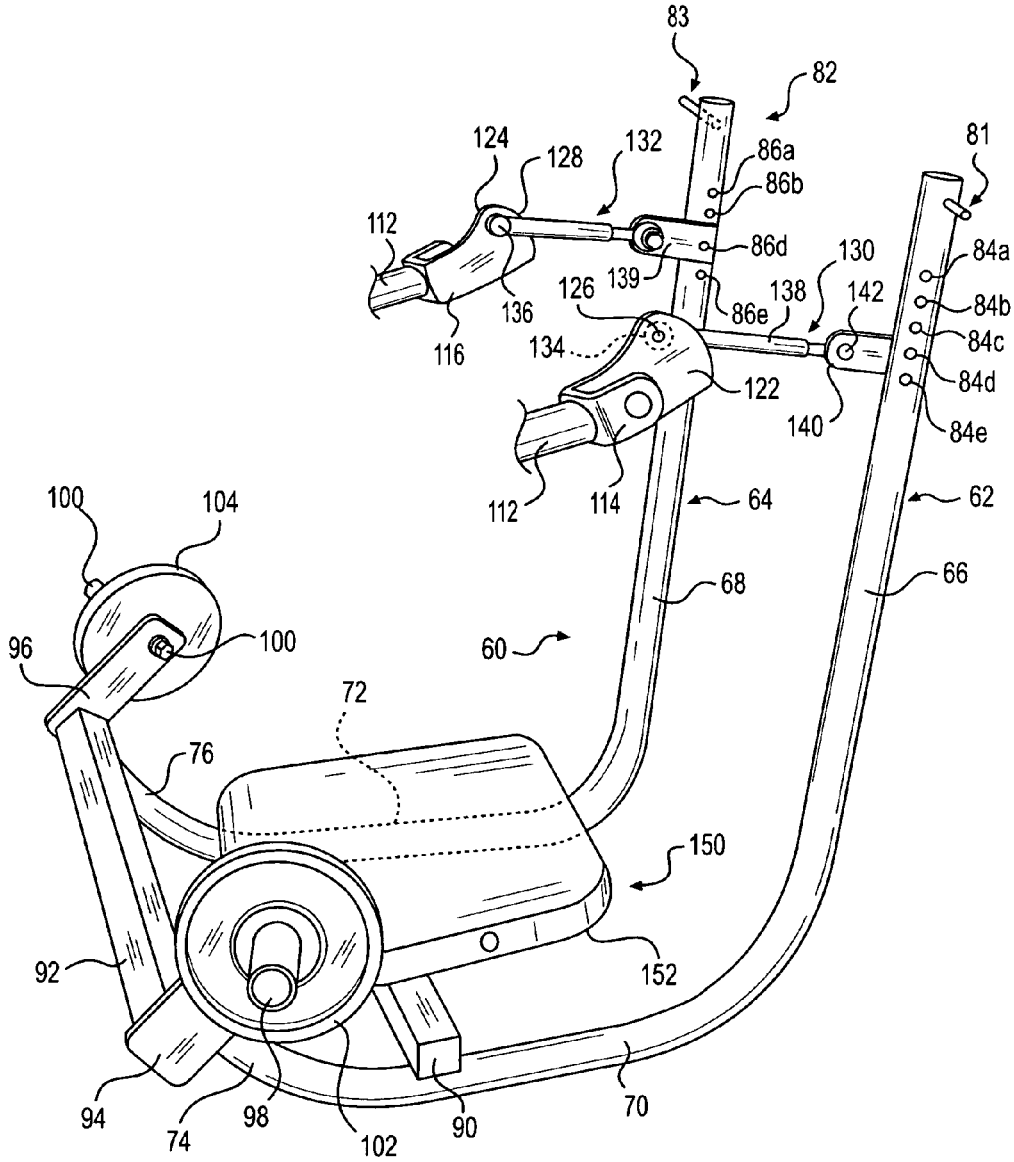
FIG. 3 shows a side perspective view of an inner frame.

FIG. 3 shows an exemplary form of an inner mechanism 60 that includes right and left members 62 and 64 each of which has a support bar or rod 80 and 83, respectively, that operatively cooperate with a pivot connection assembly, 80 and 82, respectively, shown in FIG. 2 located adjacent the rear top ends of rear supports 12/14. Each of the members 62 and 64 may be formed from, for example, tubular pieces suitably bent into a general J-shape having a straight rear section 66 and 68, and with a bottom portion thereof curving into a generally straight bottom section 70 and 72 which end at an upwardly curved forward end portions 74 and 76, respectively. It is not essential that the members be formed from tubular pieces as other cross sectional shapes could work as well.

Pivot connections in the form of pillow block assemblies 80 and 82, pivotally support the top ends of members 62/64 to the upper portion of rear supports 12 and 14, respectively. An exemplary pillow block is one manufactured by Fenner Drives®, specifically its PPD Series, PB 1039, which is a, nylon, plastic, resin or composite type of pillow block. Specifically, a support rod 81 and 83, as shown in FIG. 3, are welded or otherwise secured at the upper ends of members 62/64, respectively, and extend outwardly from the outer sides thereof. To assembly, rods 81 and 83 are inserted into pillow block assemblies 80 and 82, respectively, with the pillow block assemblies 80/82 themselves, along with the rods 81/83 in place, as an integral unit, then being bolted as a collective assembly onto their positions at the upper ends of supports 12 and 14, respectively, with one of those bolts being shown at 85 in FIG. 1. At that point the inner mechanism 60 will be attached to the outer frame 10. Rods 81/83 will pivotally support the inner mechanism 60 within the outer support frame 10 and will be strong enough to support the weight of the inner mechanism 60, the user and any additional weight that might be added to the inner mechanism.

A plurality of apertures **84*a*-84*e* and 86*a*-86*e*, respectively, are each arranged in a vertical row located adjacent the upper end of members 62 and 64. The top most apertures 84*a* and 86*a* are each positioned about 5.5 inches from the top end of members 62 and 64**. Thereafter, each succeeding lower aperture is positioned about 0.75 inches below the preceding aperture making the other apertures positioned about 6.25, 7.0, 7.75 and 8.5 inches from the top end, respectively.

At the bottom of the members 62 and 64, within sections 70 and 72, a cross member 90 is welded or otherwise attached, for example by being welded, bolted or by using epoxy, between members 62/64 to space them apart, to provide operational strength, and to provide a support for a kneeling pad assembly 150. A second cross member 92 can be provided at the outer bottom ends of members 62 and 64 and it can also be attached by welding or other secure approach, including by epoxy or by being bolted in place. Plates 94 and 96 can be welded onto the respective opposite ends of cross member 92 which can, in turn, each support a bar 98 and 100 that can be welded thereto with bars 98/100 providing a place to mount one or more standard plate type weights 102, 104 onto the bottom of the inner mechanism 60.

Members 62 and 64 can be made from steel extrusions that can have various cross-sectional shapes including circular, square, and rectangular or other bend resistant cross sections, or alternatively, they could be made from man made materials, including thermoplastics, carbon fibers, from combinations of materials, including metal and plastic, as well as from other reinforced materials or combinations of materials. One example could be a steel tube with a circular cross section having a diameter of about 1-1.5 inches. Also, the generally straight bottom sections 70 and 72 can have lengths, between the curved portions on each side thereof, of about 14 to about 20 inches, with a preferred length thereof being about 16 inches. Further, the length of the forward end portions 74 and 76 can be about 8 inches in length from the mid point of the curved section to the outer ends thereof where additional weights can be supported. If this forward end portion 74/76 were shorter, for example about 4 to about 6 inches then the moment arm would be shorter as well and exercises would be more easily accomplished and the effect of added weights would be less. Conversely, if the forward end portions 74/76 were longer, for example about 12 to about 16 inches, then the exercise routine would be harder and the effect of any additional weights would be greater.

The actuating assembly 110 comprises a forwardly mounted C-shaped bar 112 each of whose ends include a clevis assembly 114 and 116, suitably attached thereto, with each being pivotally attached to the outer ends 33 of upper sections 32 of the outer frame 10, for example by pins 115. A pair of spaced apart handles 118 are fixed, for example by being bolted, welded or otherwise fixedly attached to the front of bar 112. A pair of pads 120, or a single C or U shaped pad, for example, is also attached to the upper part of bar 112 to provide support for a bottom part of a user's upper arm as shown in FIGS. 1 and 2. While a pair of handles is shown, it should be understood that a single handle, centrally mounted on C-shaped bar 112 could also be used.

Each clevis 114 and 116 includes a pivot connector 122 and 124, respectively, that preferably extends rearwardly from the pivot connection and each connector 122/124 also includes an aperture 126 and 128 that is positioned at a convenient location so that a linkage assembly 130 and 132, respectively, can be attached, for example, at an upper edge adjacent the rear thereof.

Such a linkage assembly, or tension rod assembly, shown at 130 and 132 in FIG. 3, transfers forces from the actuating assembly to the inner mechanism to thereby apply forces that will, at least in part, move the inner mechanism 60 relative to the outer frame 10. Since the length between the connection points for this linkage assembly is adjustable modifications to that length provides an additional way to make movement of the inner mechanism harder or easier thereby producing varying degrees of difficulty in the exercise routine in addition to the ability of changing the weights being used.

Figure 4:
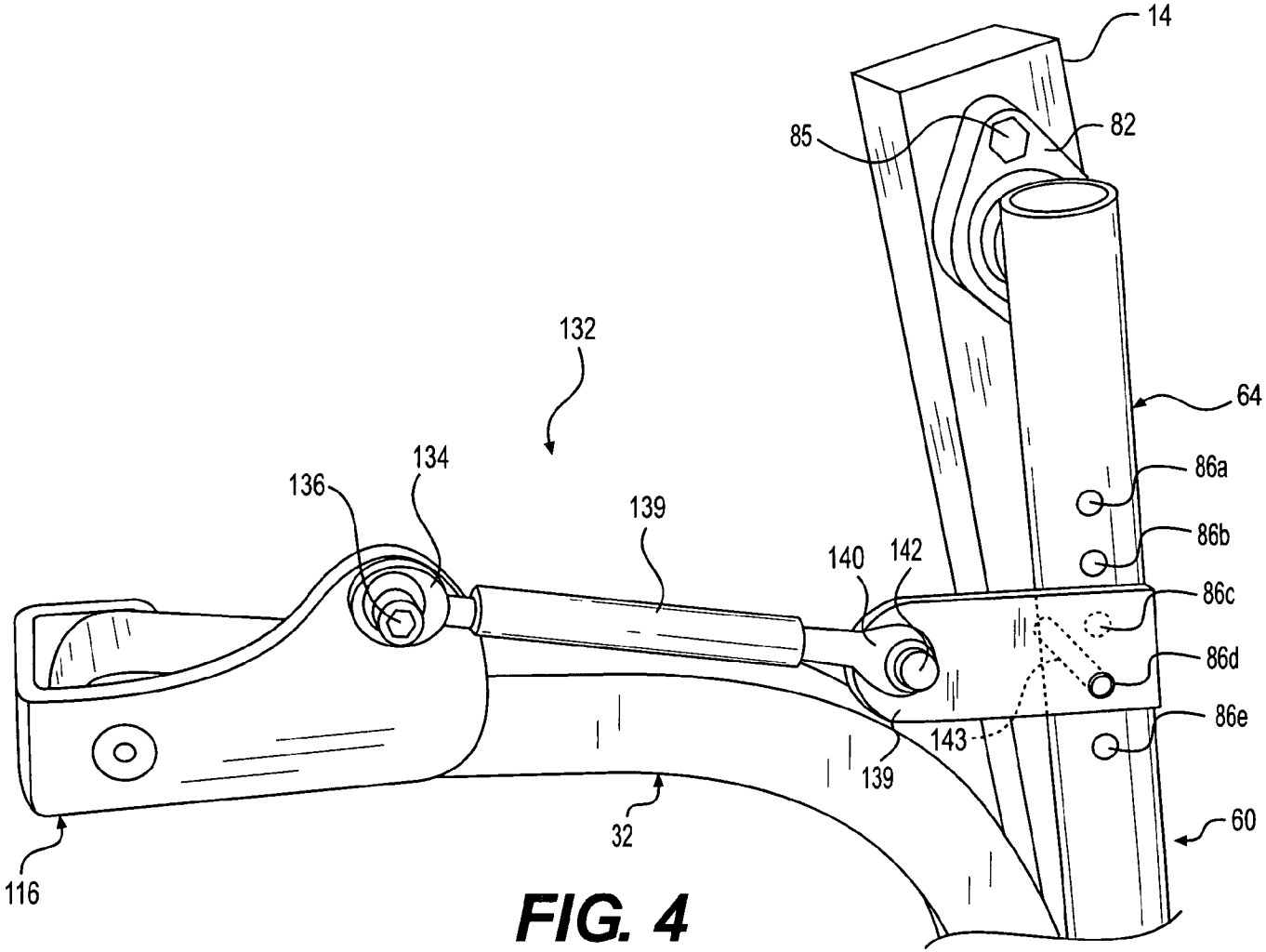
FIG. 4 is an elevational view of an exemplary drive linkage
Figure 5:
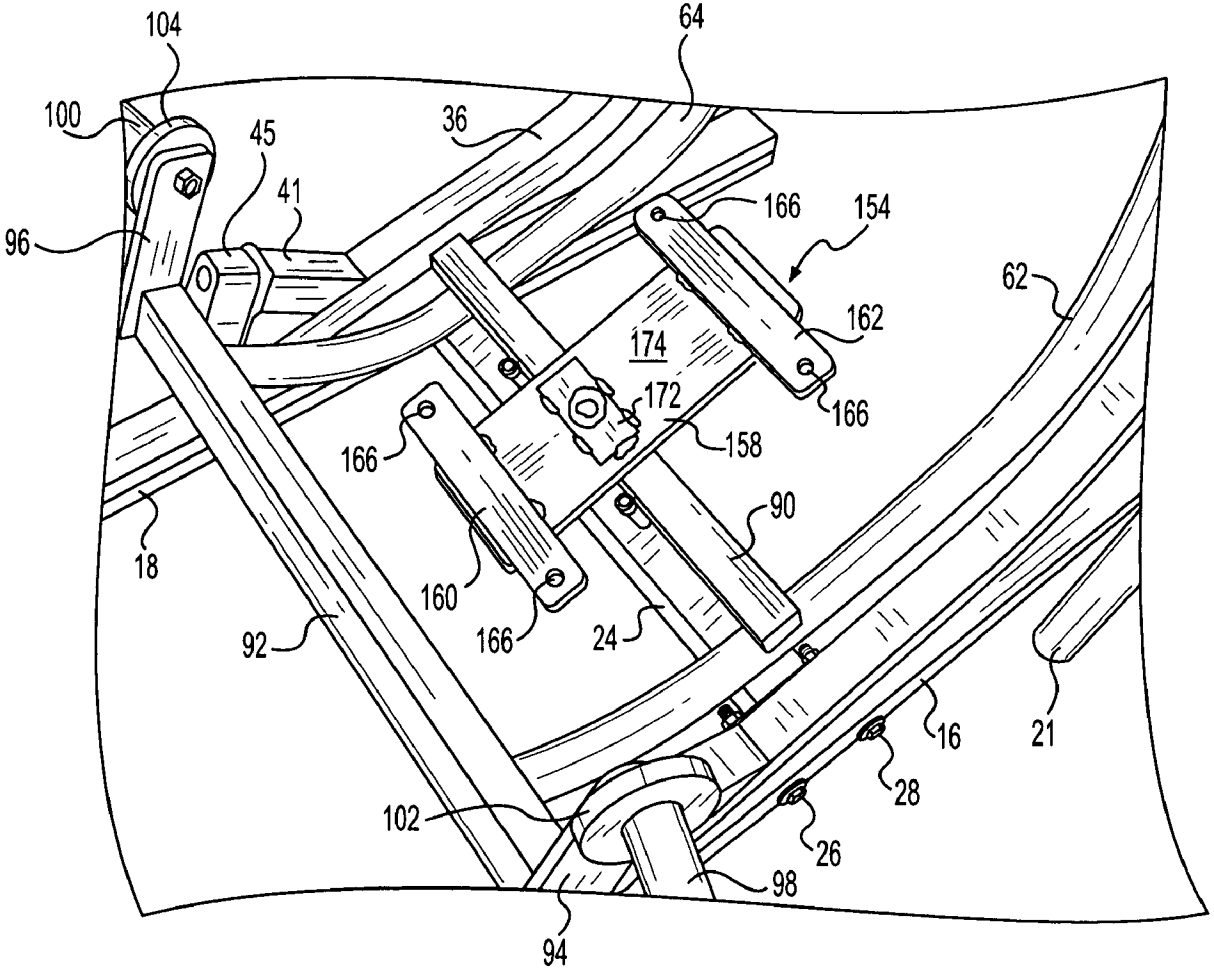
FIG. 5 is a top perspective view of a knee pad support from which the knee pad has been removed for clarity.

To accomplish that each linkage assembly 130/132 is used between one of the respective clevis members 114 and 116 and one of the plurality of apertures 84*a*-84*e* and 86*a*-86*e*. Each linkage assembly 130/132 includes, as shown in FIG. 4, a first pivot connector 134 at one end of a rod or bar 138 and 139, with bar 139 being shown in FIG. 4. Those linkages 138/139 are connected to apertures 126/128, respectively, in clevis members 114/116 by a pin 136. The bar or rod 138/139 extends rearwardly from the pivot connector 134 and pin 136 to a second pivot connector 140 that is attached by a pin 142 to an attachment plate 141 on which a separate rod or pin 143 is secured, as by welding. The rod or pin 143 on attachment plate 141 will be inserted into one of the series of apertures 84*a*-*e* or 86*a*-*e*, in the inner mechanism 60, for example in aperture 86*d* in FIG. 4. When the preferred apertures 84*d* and 86*d* are used for connection to the inner mechanism 60 each linkage or tension rod 130 and 132 will be about 8 inches long. As different inner mechanism apertures are used the length of the rod or bars 138/139, as measured between pins 136 and 142, will need to be about 1.5 inches longer or shorter depending upon whether an aperture above or below 84*d*/86*d* is to be used. For example, when apertures 84*a*/86*a* are to be used the linkages or tension rods 130/132 will preferably be about 12.5 inches long and for apertures 84*e*/86*e* the linkage will only need to be about 6.5 inches long. Thus, the length of linkages or tension rods 130/132 will be about 11 inches for apertures 84*b*/86*b* and about 9.5 inches for apertures 84*c*/86*c*. Use of apertures 84*a*/86*a* will produce less movement of and require more force from the actuating assembly 110 to move the inner mechanism 60, while use of apertures 84*e*/86*e* would permit the greatest amount of movement producible by the actuating assembly 110 of the inner mechanism 60 and with lesser force than when using the other apertures.

Figure 7:
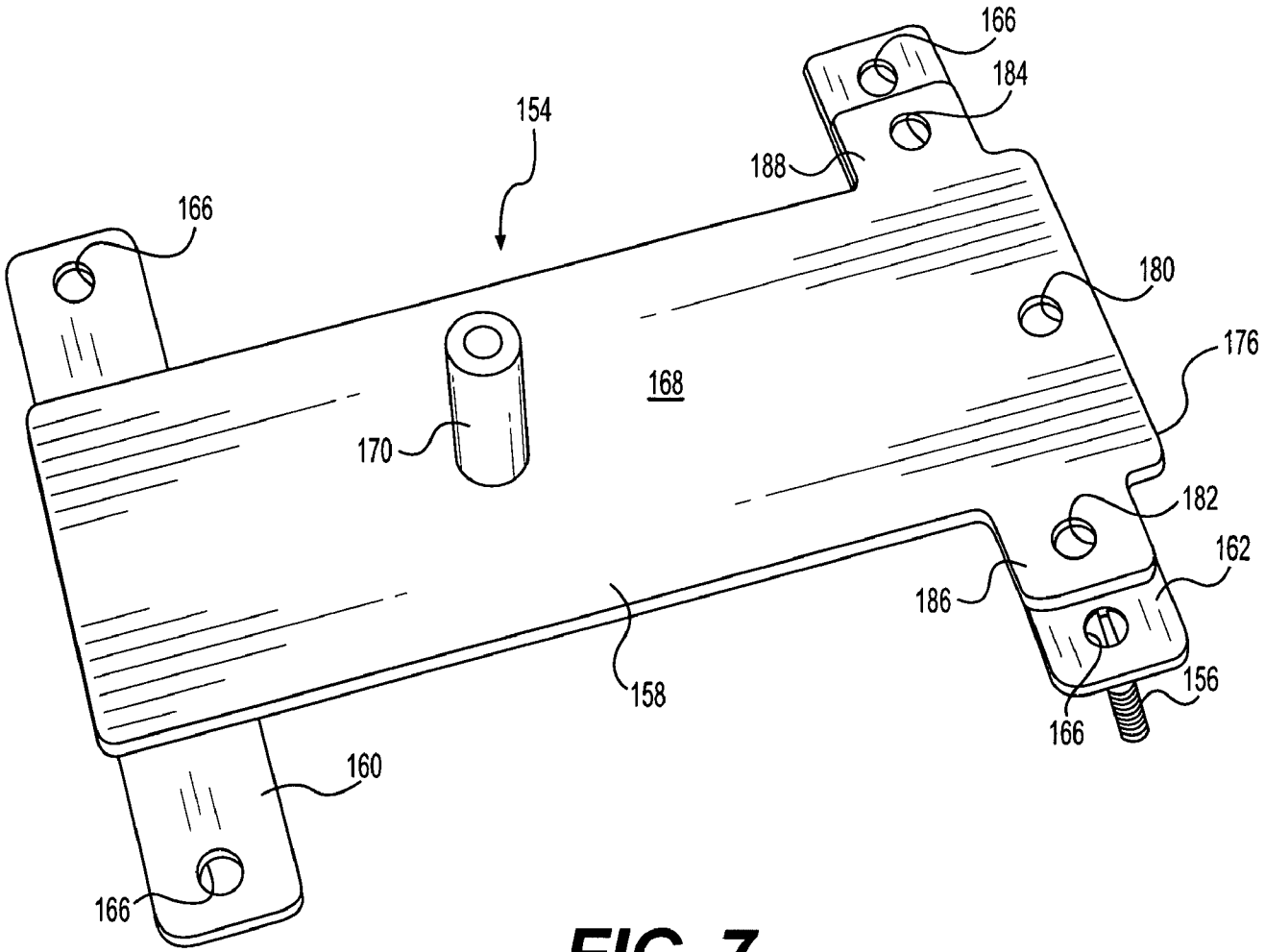
FIG. 7 is a bottom view of the knee pad support.

FIGS. 3 and 5-8 show various details of the knee pad assembly 150 that includes a knee pad 152 that is mounted on an under carriage 154. Under carriage 154 is comprised of a main plate 158 that has two cross pieces 160 and 162 mounted thereon at opposite ends, as for example, by welding or by using epoxy type adhesives. It is preferred that the undercarriage 154 be mounted at an angle of about 16° to about 20°, and preferably about 18°, to horizontal thereby providing a comfortable angle and position for supporting a user's kneeling posture thereon. Each cross piece 160/162 extends laterally beyond each of the side edges of plate 154 and in those extended portions a screw hole 166 is provided for mounting pad 152 thereto, for example, by screws 156. A post 170 extends through a suitable aperture in plate 158 to extend beyond the bottom surface 168 of plate 158 and post 170 can be mounted to a plate 172 that is itself welded onto the top surface 174 of plate 158. Post 170 could also be directly welded to plate 158. As shown in FIG. 7, the rear end 176 of plate 158 includes a set of three apertures 180, 182 and 184 with aperture 180 being in the center and apertures 182 and 184 being located at spaced positions to either side of aperture 180 in respective wings 186 and 188 formed on plate 154.

Figure 8:
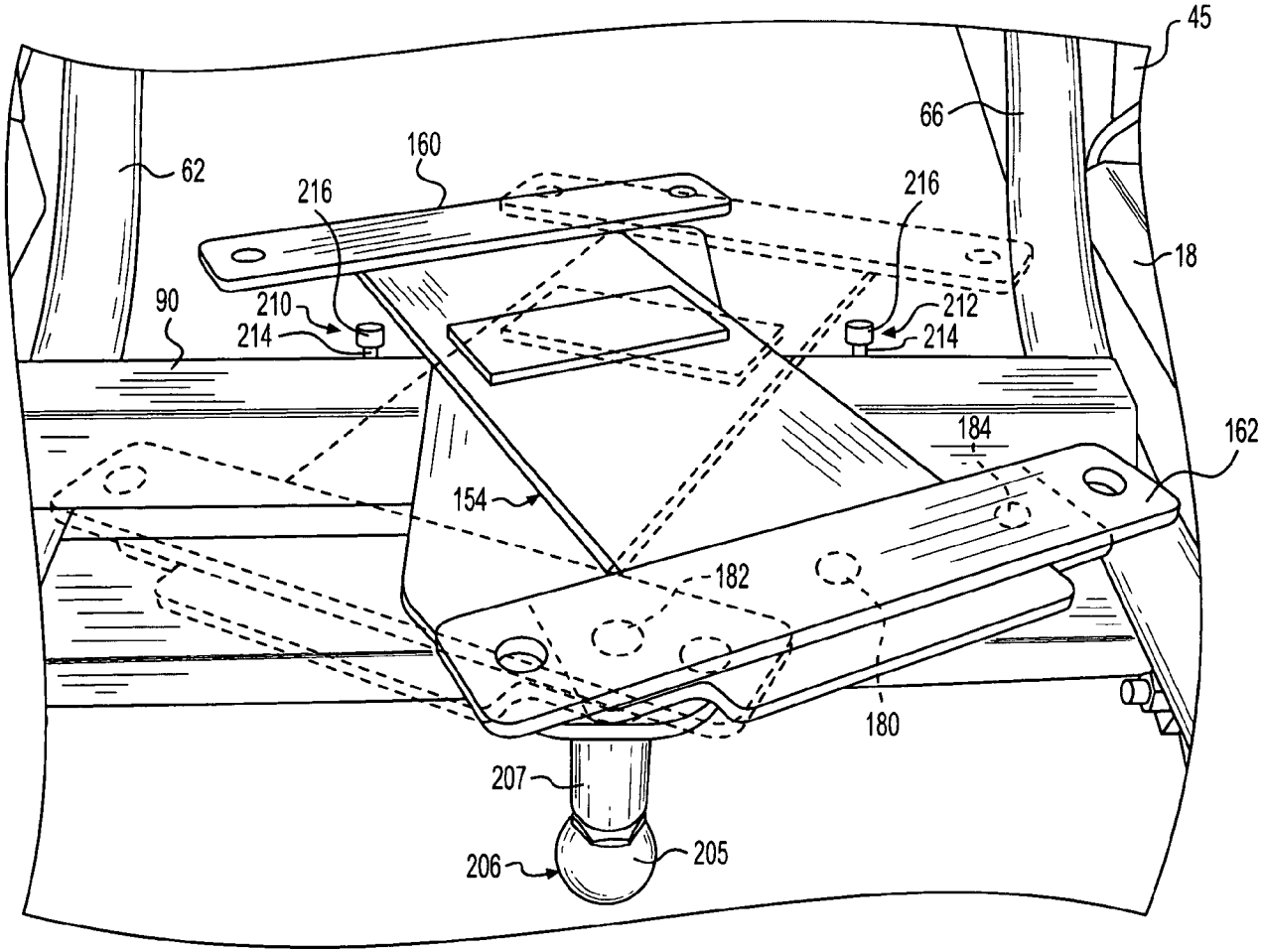
FIG. 8 shows the knee pad support in two of its pivotal positions relative to the inner frame.

FIG. 6 shows a bottom portion of knee pad support assembly 150 which includes a support plate 200 that is attached to a central portion of cross member 90 by any convenient means including, for example, welding, bolts and epoxy type adhesives. Plate 200 includes a central bore 202 into which post 170 can be rotatably received and has an upper surface 201. Plate 200 also supports a pop pin assembly 204 at a rear end 206 thereof. A pair of stops 210 and 212, can be in the form of rods 214 having a nylon or rubber cylinder 216 attached at an upper end thereof. Rods 214 can be welded or otherwise fixed to the front of cross member 90 at spaced apart locations that can be about 1 to about 4 inches from the sides of plate 200, and preferably about 1.5 inches away from the sides of plate 200. When the undercarriage 154 is mounted on plate 200 and with post 170 within bore 202, post 170 will be able to rotate within bore 202 thereby allowing the undercarriage 154 to rotate on surface 201 relative to plate 200 which remains fixed. Consequently, knee pad 152 will be rotatable between stops 210 and 212. Stops 210 and 212 control and limit the amount of rotation as shown in FIG. 8 where the full line drawing shows the full counter clockwise rotation position and the dotted line portion shows the full clockwise rotation position. Pop pin assembly 204 includes a pin 208 that will function together with apertures 180-184 to control the positioning of knee pad 152 through the interaction of pin 208 with apertures 180-184. In fact, pop pin assembly 204 has two modes of operation. In one mode the handle 205, which is spring mounted in a cylindrical casing 207, can be pulled down and turned to thereby lock the internal pin 208 in a withdrawn and locked condition. When in that mode, the undercarriage 154, and consequently the knee pad 152, can freely rotate back and forth between stops 210 and 212. In the second mode of operation handle 205 can simply be pulled down, to pull the pin into cylinder 207 thereby releasing the pin from its position on one of apertures 180-184. Assuming the pin had been in aperture 180 once the pin is pulled down the knee pad can be rotated in either a clockwise or counter clockwise manner and then the handle can be released to once again allow the pin 208 to enter either aperture 182 or 184 and thereby lock knee pad in a new rotated yet fixed position.

D. Operation

In operation a user will kneel on pad so that the knees and the front of the calves are in contact with pad 152 and this position is shown in FIG. 1 in dotted line. In addition, the bottom of the user's upper arms are resting on pads 120 that are fixed to the top of bar 112 adjacent handles 118. The user then grips the outer ends of handles 118. That is the position shown in FIG. 1. Then, the user pulls down on handles 118 and pushes down on pads 120 while simultaneously contracting the abdominal muscles. That combined action forces the actuating bar 112 downwardly and places linkages 130/132 and pulls against pivot connections 140, against pins 142 and thus on the upper ends of members 62/64 which is caused to pivot relative to frame 10 via pivot connections 80 and 82.

As the arms provide further downward force and as the abdominal muscles are tightened the user's body evolves into a crunch position with the knees being pulled upwardly as the arms and shoulders move downwardly thereby resulting in a compound movement between the inner mechanism 60 and the arm or bar 112. As this movement continues, a more defined crunch position is established with the knees and lower legs being pulled upwardly. As this position is reached the inner mechanism is swung forwardly by the linkages 130/132 not only against the weight of the user by against the added weight supplied by any weights added to pins 98 and 100.

Reversal of this crunching action by applying less downward force by the arms and on the handles 118, as well as by relaxing the abdominal muscles allows the inner mechanism to rotate in a counter clockwise direction back toward the position shown in FIG. 1 until members 62/64 once again engage bumpers 44/45 at which point the inner mechanism is at a rest or start position.

E. Options and Alternatives

The inner mechanism 60 can have shapes for the members 62/64 other than the general "J-shape" disclosed herein. For example, each member 62/64 could be shaped in a straighter manner that would extend more directly from the pivot connections 80 and 82 to a bottom location where a kneeling support could be provided. The linkage 130/132 may be lengthwise adjustable in other ways, for example by use of a turn buckle, or a pinned cylinder and rod arrangement, to vary the length of the linkage, or it could be otherwise positioned on members 62/64 by use of pop pin assemblies or by being hooked thereto. Also, while a number of fastening techniques have been referenced it should be understood that where secure connections are desired any form of fastening that will produce a strong joint will be useful and its use is within the scope of this disclosure.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. An exercise device comprised of an outer frame having an upper portion and a lower floor supporting portion;

an inner mechanism having a upper portion and a lower portion with the inner mechanism upper portion being pivotally connected at one set of pivot assemblies to the upper portion of the outer frame so that the lower portion of the inner mechanism can swing about the pivot connection between actuated and rest positions away from and toward the outer frame; and an actuating assembly pivotally attached to the outer frame at a separate point spaced outwardly from said one set of pivot assemblies, the actuating assembly including actuating arms and a length adjustable linkage assembly interconnecting the actuating arms and the upper portion of the inner mechanism so as to produce an adjustable pull force thereon as the actuating arms are moved, the inner mechanism further including a knee pad structure within the lower portion of the inner mechanism supporting a kneeling user, wherein the actuating assembly and the knee pad structure move toward each other as the inner mechanism is moved away from the rest position toward the actuated position, the inner mechanism comprises a pair of substantially J-shaped members having rear, bottom and forward end sections, a cross beam located within the bottom section pivotally supporting the knee pad structure, the forward end sections include a weight plate support assembly fixed thereto.

2. The exercise device as in claim 1 wherein the outer frame includes a pair of spaced apart rear mounted upright supports and a pair of spaced apart horizontally extending floor supports.

3. The exercise device as in claim 2 wherein the floor supports further include at least one cross support fixed there between.

4. The exercise device as in claim 1 wherein the inner mechanism includes a pair of spaced apart members and the knee pad structure includes a kneeling pad fixed between the members at a position located adjacent but above a bottom portion of the members.

5. The exercise device as in claim 1 wherein the inner mechanism is comprised of a pair of spaced apart J-shaped members.

6. The exercise device as in claim 1 wherein the linkage assembly is attached to the upper portion of the inner mechanism at one of a plurality of spaced apart locations.

7. The exercise device as in claim 6 wherein the plurality of spaced apart locations provide varying degrees of difficulty in moving the inner mechanism.

8. The exercise device as in claim 1 wherein the actuating assembly further comprises at least one handle mounted to the actuating arms and a set of support pads mounted to the actuating arms.

9. The exercise device as in claim 8 further including a pivotally mounted knee pad structure.

10. The exercise device as in claim 9 wherein the pivotally mounted knee pad structure is lockable in one of a plurality of positions.

11. The exercise device as in claim 1 wherein the forward end sections have a length that varies from about 4 inches to about 16 inches.

12. The exercise device as in claim 11 wherein the pad structure pad structure includes a pad attached to a pad support, a support assembly that pivotally retains the pad support and a pop-pin assembly, attached to the support assembly, for controlling the pivotal movement of the knee pad support relative to the support assembly.

13. The exercise device as in claim 1 wherein the actuating assembly is attached to the inner mechanism at one of a plurality of connection points.

14. The exercise device as in claim 1 wherein the inner mechanism further includes a the weight plate support assembly.

15. An abdominal and upper body exercise device comprising:

an outer frame having a lower floor contacting portion and an upstanding portion;

an inner mechanism pivotally attached to an upper portion of the upstanding portion; the inner mechanism including a pair of frame elements, each having a pivot connection to the upstanding portion at an upper portion of the frame elements; at least one cross member supporting a knee pad and the at least one cross member spanning across a bottom portion of the pair of frame elements, the inner mechanism further includes a weight plate support assembly;

a length adjustable linkage assembly attached to the upper portion of each of the pair of frame elements at one of a plurality of first connection points spaced from the pivot attachment to the outer frame;

an actuating assembly pivotally attached to the outer frame and further including at least one handle and a second connection point for the linkage assembly positioned at a point spaced from the actuating assembly pivot attachment to the upstanding portion; and wherein the linkage assembly is connected between the actuating assembly and the inner mechanism, respectively, so that when the user's knees rest on the knee pad and the user pulls down on the actuating assembly the inner mechanism is rocked relative to and within the outer frame about the pivot attachment for the inner mechanism whereby the knee pad and actuating assembly move toward one another to provide an abdominal crunching exercise.

16. An exercise device comprised of an outer frame having upper and lower portions, an inner mechanism pivotally connected at one set of pivot assemblies to an upper part of the outer frame so as to be movable along an arc between rest and actuated positions, the inner mechanism further including a knee pad structure for supporting a user on a lower portion of the inner frame and an actuating assembly movably attached to the outer frame, the inner mechanism further includes a weight plate support assembly at a separate point located on a user side of the one set of pivot assemblies and additionally linked by an adjustable linkage system to the inner mechanism so that when the actuating assembly is moved in a downward arc such movement will produce a pulling force on the upper portion of the inner mechanism adjacent and below the one set of pivot assemblies to pull the inner mechanism from the rest position toward the actuated position so that with the user's knees resting on the knee pad, pulling down on the actuating assembly will move the knee pad and actuating assembly toward one another to provide an abdominal crunching exercise.

17. An abdominal and upper body exercise device comprising:

an outer frame;

an inner mechanism pivotally attached to the outer frame; the inner mechanism including a pair of frame elements, each having a pivot connection at one end thereof to the outer frame so that the pair of frame elements can swing about their respective pivot connection between actuated and rest positions away from and toward the outer frame; at least one cross member attached to and spanning across a bottom portion of the pair of frame elements; a support pad attached to the cross member; at least one connection point for a linkage assembly to each of the pair of frame elements, the at least one linkage connection point being positioned at a point spaced from the pivot connection to the outer frame; a weight plate support system;

an actuating assembly pivotally mounted to the outer frame and further including at least one handle and at least one connection point for the linkage assembly positioned at a point spaced from the actuating assembly pivot connection to the outer frame;

wherein the linkage assembly includes at least first and second connectors that are connected between the actuating assembly and the inner mechanism, respectively; and wherein the pivot connection is located at an upper portion of the outer frame, said at least one cross member is attached to a lower portion of the inner mechanism and the at least one linkage assembly connection point is adjustably positioned at a point spaced from the inner mechanism pivot connection and the first and second connectors are length adjustable, wherein the actuating assembly and the support pad move toward each other as the inner mechanism is moved away from the rest position toward the actuated position.

18. An exercise device comprised of an outer frame, an inner mechanism pivotally connected at one set of pivot assemblies to an upper part of the outer frame so that the inner mechanism is pivotal about the one set of pivot assemblies between rest and actuated positions, and an actuating assembly pivotally attached to the outer frame at a separate point spaced outwardly from said one set of pivot assemblies and additionally linked to the inner mechanism so as to produce an adjustable pull force thereon, the inner mechanism further including a pad structure supporting a user;

the inner mechanism comprising a pair of substantially J-shaped members having rear, bottom and forward end sections, a cross beam located within the bottom section pivotally supporting the pad structure;

the forward end sections including a weight plate support assembly fixed thereto and having a length that varies from about 4 inches to about 16 inches;

the pad structure including a pad attached to a pad support, a support assembly that pivotally retains the pad support and a pop-pin assembly, attached to the support assembly, for controlling the pivotal movement of the pad support relative to the support assembly; and wherein the actuating assembly includes an actuating bar and a linkage structure positioned between and pivotally attached to the actuating bar and the inner mechanism and has a length that is adjustable, wherein the actuating assembly and the pad structure move toward each other as the inner mechanism is moved away from the rest position toward the actuated position.

* * * * *